US005887645A

United States Patent [19]

Rukavina

[11] Patent Number: 5,887,645

[45] Date of Patent: Mar. 30, 1999

[54] METHOD AND APPARATUS FOR CONTINUOUS CASTING WITH SPEED SYNCHRONIZATION

[75] Inventor: Ronald A. Rukavina, Leechburg, Pa.

[73] Assignee: Allegheny Ludlum Corporation, Pittsburgh, Pa.

[21] Appl. No.: 745,240

[22] Filed: Nov. 8, 1996

[51] Int. Cl.[6] ..... B22D 11/06; B22D 11/20

[52] U.S. Cl. ..... 164/454; 164/413; 164/479; 164/480; 164/481

[58] Field of Search ..... 164/454, 413, 164/428, 429, 479, 480, 481, 432

[56] References Cited

U.S. PATENT DOCUMENTS 4,341,259 7/1982 Lauener ..... 164/454

4,678,719 7/1987 Johns et al. ..... 428/593

5,293,926 3/1994 Love et al. ..... 164/479

FOREIGN PATENT DOCUMENTS 63-171257 7/1988 Japan ..... 164/454

*Primary Examiner*—Kuang Y. Lin

*Attorney, Agent, or Firm*—Patrick J. Viccaro; Robert J. Pugh

[57] ABSTRACT

A method and apparatus are provided for direct casting of metal alloys from molten metal to continuous sheet or strip product while synchronizing the speeds of the casting surface and driven rolls by providing a master-slave relationship for controlling the casting process.

8 Claims, 3 Drawing Sheets

FIG. 1
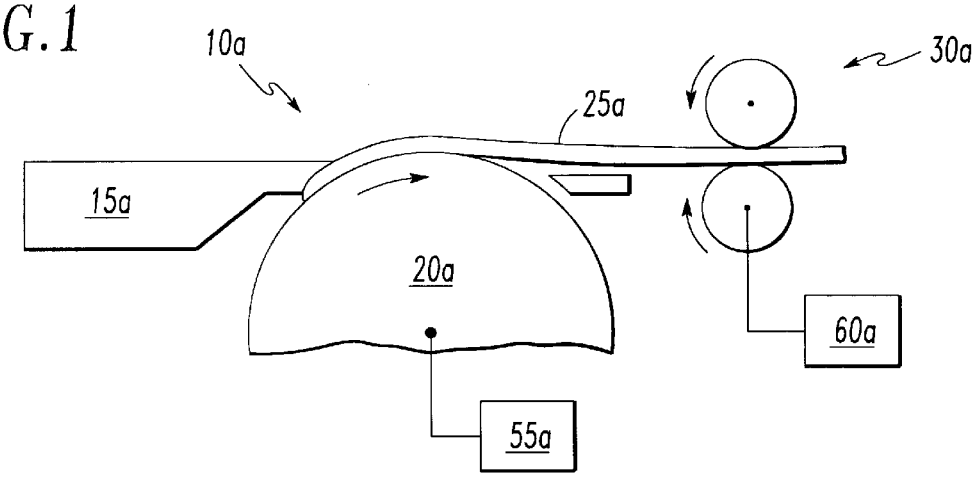
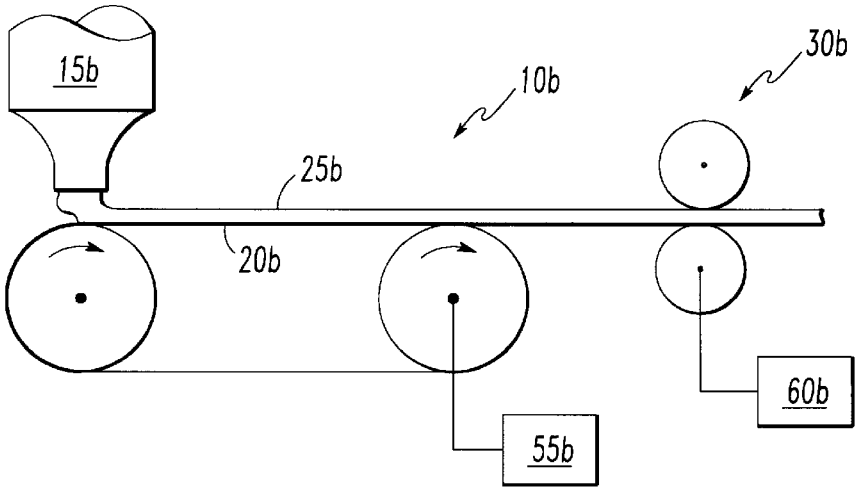
FIG. 2
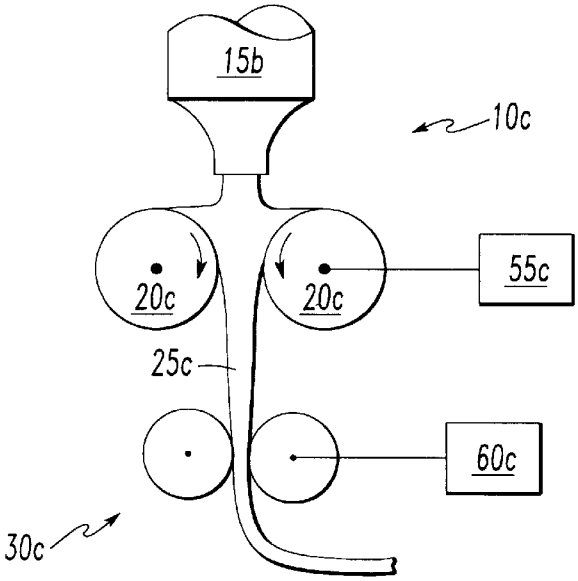
FIG. 3

METHOD AND APPARATUS FOR CONTINUOUS CASTING WITH SPEED SYNCHRONIZATION

BACKGROUND OF THE INVENTION

1. Field of the Invention

This invention relates to a method and apparatus for direct casting of metal alloys from molten metal to continuous sheet or strip product. More particularly, it relates to synchronizing the speed of the cast strip to maintain strip integrity for subsequent operations.

2. Background

There is a wide variety of methods and apparatus proposed for the production of directly cast strip. Typically, such methods are those which include spraying molten metal through a metering orifice across a gap to a rapidly moving quenching surface, such as a wheel or continuous belt; methods which partially submerge a rotating quenching surface into a pool of molten metal; methods which use horizontal link belts as quenching substrates upon which molten metal flows for solidification; and methods of casting with twin casting rolls having a pool of molten metal therebetween. Some of the processes have the capability of casting the strip horizontally and others for casting the strip in a vertical direction.

Although none of the direct casting processes proposed are known to have developed into commercial processes, each is potentially capable of producing an as-cast near net shape sheet or strip product. That product is then subjected to downstream operations to develop the final sheet or strip product. Such operations may include cold rolling, skinpass rolling, annealing and pickling, as well as cutting and slitting operations. U.S. Pat. No. 5,045,124, issued Sep. 3, 1991, discloses a process wherein the cast strip is thereafter skinpass rolled. Such downstream operations frequently may include a pair of rolls, such as pinch rolls, which may be used for such skinpass rolling or for cooling the cast strip, reducing its gauge, or smoothing the top and bottom surfaces of the strip. Furthermore, it has been found that through the use of a pinch roll set, the tension and compressive forces created further downstream by subsequent operations can be isolated from disturbing the casting process upstream. This is especially important when continuously transporting hot strip from a casting wheel in a manner such as that disclosed in U.S. Pat. No. 5,293,926, issued Mar. 15, 1994. One problem identified for many of the various processes is that the as-cast strip may have an uneven or rough top or bottom surface which creates speed disturbances in the pinch roll and results in buckles or breaks in the as-cast strip upstream toward the caster.

What is needed is a method and apparatus for direct casting sheet and strip having surface quality comparable to or better than conventionally-produced strip to enhance commercialization of such processes. Such a method and apparatus should be able to produce sheet and strip products by transporting the as-cast strip from the casting surface or surfaces to the pinch roll without the occurrence of breaks or buckles in the strip therebetween. The direct cast strip should have good surface quality, edges and structure and properties at least as good as conventionally-cast strip.

SUMMARY OF THE INVENTION

In accordance with the present invention, a method is provided for directly casting molten metal into continuous metal strip. The method include supplying molten metal to at least one moveable cooling casting surface, moving the casting surface by a first drive means, and separating the continuous cast strip from the casting surface. The method includes transporting the separated strip from the casting surface continuously through the roll bite of at least one pair of rolls, driving that pair of rolls by a second drive means, and synchronizing the speeds of the casting surface and driven rolls by providing a master-slave relationship for controlling casting. The speed and position of the driven rolls are the master and the speeds of the casting surface and casting surface motor means are the slave.

An apparatus is also provided for directly casting molten metal to continuous metal strip, including a moveable casting surface, means for supplying molten metal to the casting surface, and a first drive means for driving the casting surface. The apparatus also includes at least one pair of driven rolls, a second drive means for driving those rolls, and a means for transporting the separating strip continuously through the roll bite of the pair of driven rolls. A means is provided for synchronously controlling the angular position and speed of the driven roll means and casting surface using a master-slave relationship.

BRIEF DESCRIPTION OF THE DRAWINGS

FIG. 1 is a schematic of a single wheel strip casting apparatus.

FIG. 2 is a schematic of a double wheel strip casting apparatus.

FIG. 3 is a schematic of a vertical strip casting apparatus.

DETAILED DESCRIPTION OF THE PREFERRED EMBODIMENTS

Figure 4:
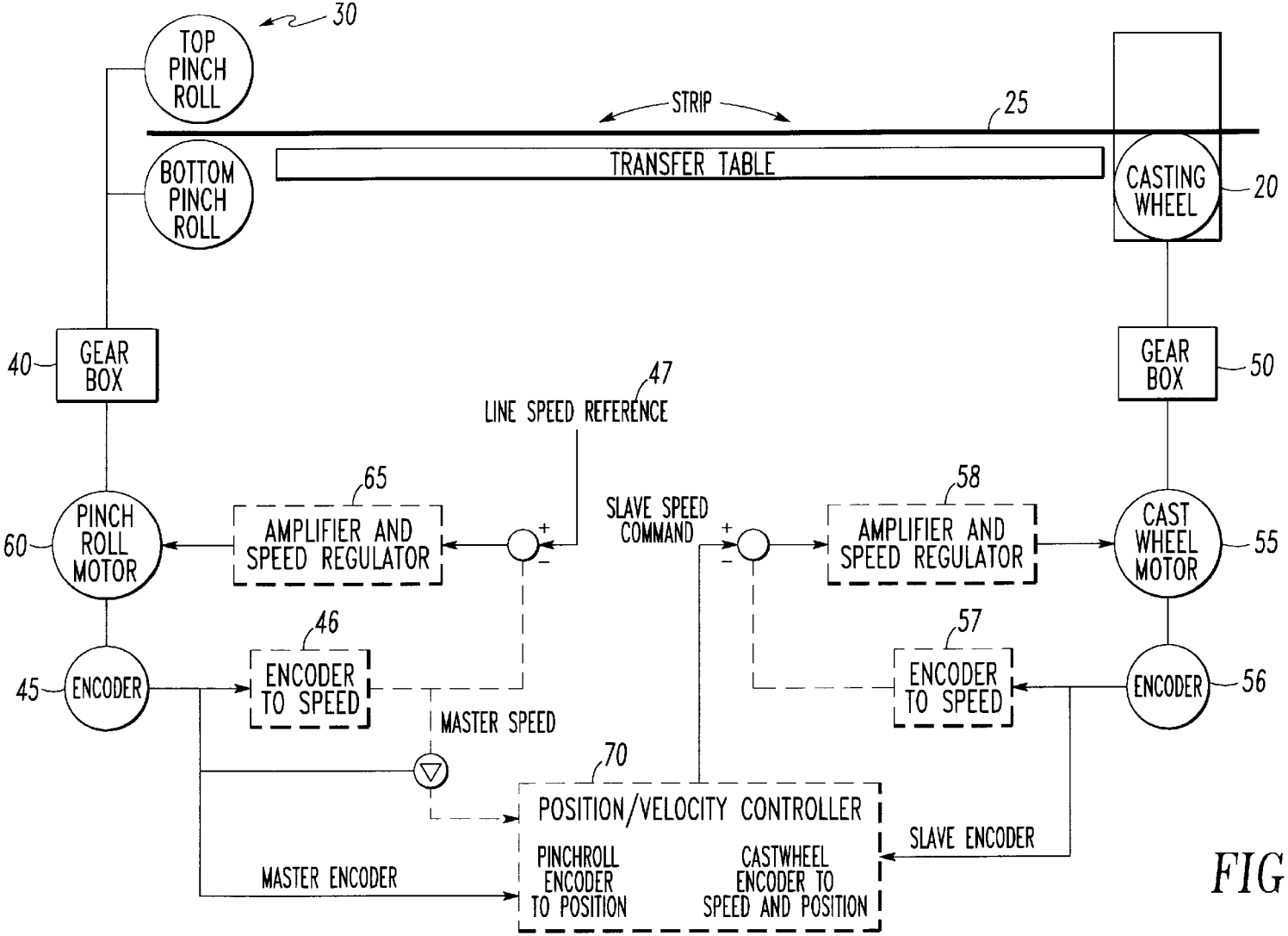
FIG. 4 is a schematic diagram of speed control system of the present invention.

FIG. 1 is a schematic of a single wheel casting apparatus 10*a* such as that disclosed in U.S. Pat. No. 5,293,926. FIG. 1 generally illustrates a casting vessel 15*a* for directly casting molten metal on a casting surface 20*a* to produce continuous product in strip or sheet form 25*a* before passing through the roll bite of pinch rolls 30*a*. Casting surface 20*a* is moved by first drive means 55*a* and pinch rolls 30*a* are driven by second drive means 60*a*.

FIG. 2 is a schematic of a horizontal strip casting apparatus 10*b*. FIG. 2 generally illustrates a casting vessel 15*b* for directly casting molten metal on a horizontal belt casting surface 20*b* to produce continuous product in sheet or strip form 25*b* before passing through downstream pinch rolls 30*b*. Casting surface 20*b* is moved by first drive means 55*b* and pinch rolls 30*b* are driven by second drive means 60*b*.

FIG. 3 is a schematic of a double wheel casting apparatus 10*a*. FIG. 3 generally illustrates a casting vessel 15*c* for directly casting molten metal through casting surfaces 20*c* to produce continuous product in sheet or strip form 25*c* before passing through downstream pinch rolls 30*c*. Casting surfaces 20*c* are moved by first drive means 55*c* and pinch rolls 30*c* are driven by second drive means 60*c*.

For purposes of the present invention, each of the three casting processes represented in FIGS. 1, 2, and 3 have similarities which render them useful for the present claimed invention. Particularly, each of the processes include a molten metal supply, a casting vessel, moving casting surface, and a downstream pair of rolls through which the cast strip passes. As used herein, the reference numerals 10,

15, 20, 25, 30, 55, and 60 may be used without the "a", "b", or "c" modifiers shown in FIGS. 1–3, because of the similar function of the apparatus features.

The supply of molten metal to the casting vessel 15 may be accomplished by any suitable conventional methods and apparatus of vessels, tundishs, or molten metal pumps, for example.

The casting surface may be a single casting wheel surface 20*a*, a single horizontal surface 20*b*, or one of twin casting wheel or roll surfaces 20*c*. The casting surface 20 must be moveable past the casting vessel 15 at controlled speeds and be able to provide the desired quench rates to extract sufficient heat to at least initiate solidification of the molten metal into strip form.

While it was known to include downstream pinch rolls 30 to effect smoothing or further cooling or gauge reduction or isolation of compressive or tension forces on the strip, synchronization was insufficient to avoid upstream tearing or breakage or buckling of the strip. FIG. 4 is a schematic diagram of a speed control scheme of the present invention. An important feature of the speed synchronization is to provide a master-slave relationship between the speeds of several elements of the apparatus to control the process. It was found that the pair of rolls in pinch roll 30 should be driven. Furthermore, it was found that the speeds of the casting surface 20 and driven pinch rolls 30 should be synchronized in master-slave relationship in order to control the casting process. The angular speed and position of the driven pinch rolls 30 are the master and the speeds of the casting surface and the casting surface motor, i.e., first drive means, are the slave.

FIG. 4 illustrates a position/velocity controller 70 used to control the angular position of the casting surface drive means 55 which is intended to exactly track the position/velocity of the pinch roll drive means 60. Disturbances occurring at pinch roll 30, such as the result of downstream tension or compression of the cast strip 25, controller 70 would respond with a speed correction to the casting surface drive means 55 to avoid any position error that may occur between the pinch roll 30 and the casting surface 20.

More particularly, FIG. 4 illustrates pinch rolls 30 connected through drive shafts to a gear box 40 and a second drive means or motor 60. The pinch roll drive 60 means is connected to an encoder 45 for coding the information about the speed and position of the drive means 60. This information is then fed back through the position/velocity controller 70 and to the amplifier speed regulator 65 and then to the pinch roll drive means 60. Preferably, the second drive means 60 is connected to encoder to speed converter 46 interposed between encoder 45 and position/velocity controller 70. Encoder to speed converter 46 decodes information about the speed of drive means 60. A line speed reference 47 also is preferably used to feed information to the amplifier and speed regulator 65. The line speed reference 47 is the electronic equipment speed limitation, if any, such as 0–350 feet per minute (0–1.778 meters per second).

The casting surface 20 is connected through a gear box to 50 the casting wheel drive means 55 to an encoder 56 for coding information about the speed and position of the casting surface 20 and casting surface drive means 55. As shown in FIG. 4, the casting surface speed and the casting surface drive means 55 are connected in a slave relationship to the speed and position of the driven pinch rolls 30. Preferably, the first drive means 55 is connected to encoder 56 and then to encoder to speed converter 57 interposed between encoder 56 and amplifier and speed regulator 58. The angular speed and position information from the encoder 56 is then fed through the position/velocity controller 70 and then to the amplifier and speed regulator 58 and then to the casting surface drive means 55.

With this control scheme, there is little to no position error between the casting surface 20 and the pair of pinch rolls 30. Such an arrangement eliminates any strip damaging tension or compression in the cast strip after leaving the casting vessel 15 and casting surface 20 which would form breaks or buckles in the strip. This applies as long as there is no slip between the cast strip 25 and the roll bite of pinch rolls 30. By the combination of a "soft" speed regulator for the pinch roll system and correct downward force of top pinch roll 30, slip can be eliminated.

EXAMPLE

Figure 5:
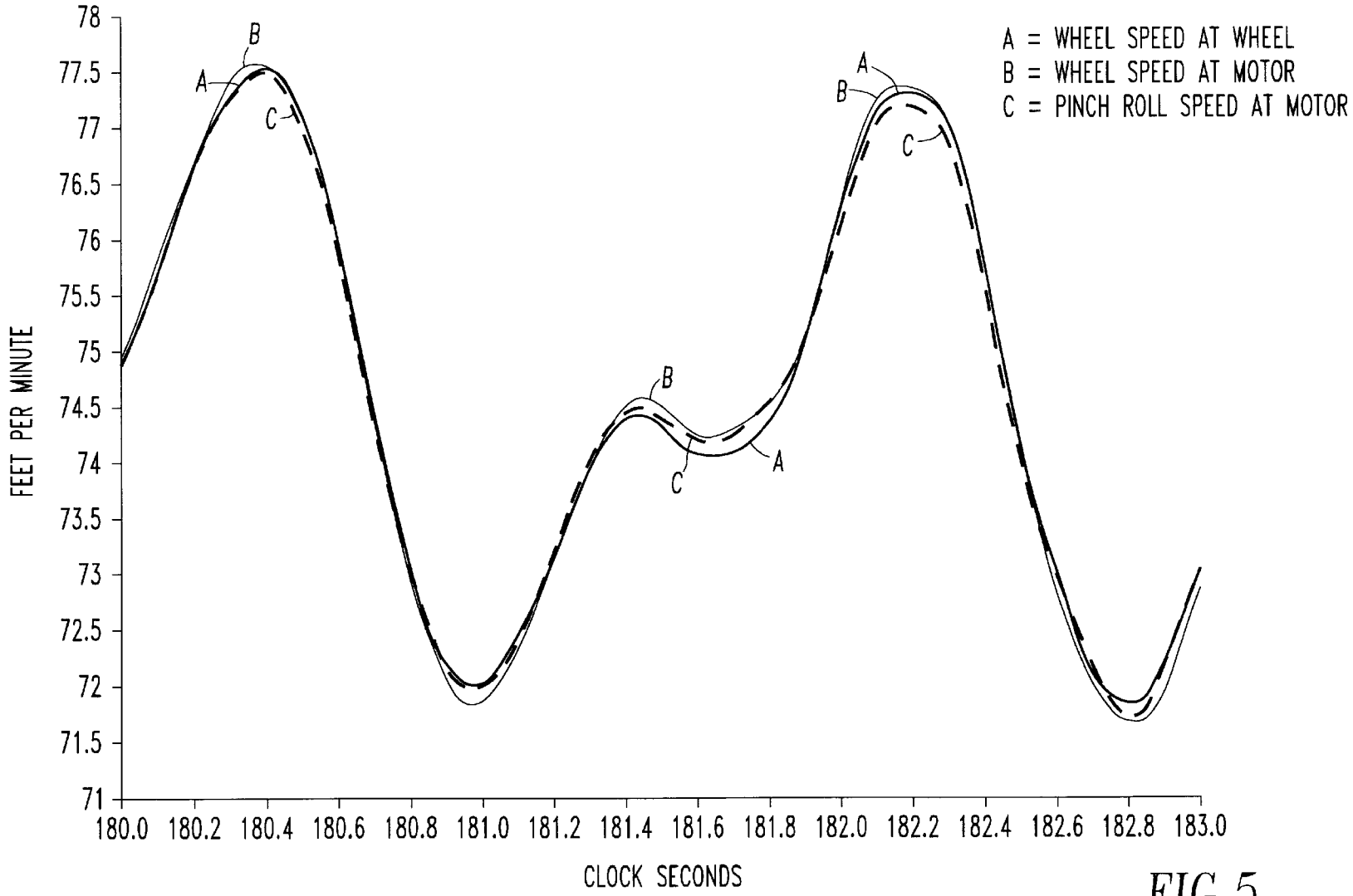
FIG. 5 is a sample of recorded speed signals of the casting process of the present invention.

The method of the present invention was tested by casting stainless steel strip using the method and apparatus described in U.S. Pat. No. 5,293,926. The method produced strip having a gauge of about 0.045 inch and having uniform thickness and flatness and having a smooth upper and lower surface with no porosity in the sheet. Furthermore, the sheet was cast and transported through the controls 30 without breaks or buckles in the as-cast strip. This was found to be particularly helpful when using the method of U.S. Pat. No. 5,293,926 which separates the cast strip in semi-solid form from the casting surface 20 before the strip is solidified. While the process of that patent contemplates substantially no net forces on the semi-solid cast strip, upstream tearing or breakage, as well as buckling, may result from gravitational forces, too much tension or speed disturbances in the pinch roll as a result of uneven surfaces or possibly slag that remains on the strip. As shown in FIG. 5, the three main parameters, casting surface speed A, speed of the casting surface drive means B, and speed of the pinch roll drive means C all tracked very well, as represented by the portion of the cast.

As was an objective of the present invention, the method and apparatus provides an uncomplicated and direct method for direct casting metal strip or sheet from molten steel to a continuous strip product. The subsequent handling of the strip after casting avoids tears, breaks, buckles, and the like in the strip which could adversely affect its surface quality as well as integrity.

Accordingly, while the method and apparatus of the present invention have been described in connection with the foregoing preferred embodiments, it to be understood that the method and apparatus of the present invention may be modified without departing from the scope of the invention.

What is claimed is:

1. A method of directly casting molten metal into continuous metal strip, the method comprising:

supplying molten metal to at least one movable cooling casting surface, moving the casting surface by a first drive means, separating the continuous cast strip from the casting surface, transporting the separated strip from the casting surface continuously through the roll bite of at least one pair of rolls, driving the pair of rolls by a second drive means, and synchronizing the speeds of the casting surface and driven rolls by providing a master-slave relationship for controlling casting, the speed and angular position of the driven rolls being master and the speeds of the casting surface and casting surface drive means being slave.

2. The method of claim 1 wherein supplying molten metal supplies metal to a single casting surface.

3. The method of claim 2 wherein the single casting surface is a casting roll surface.

4. The method of claim 1 wherein supplying molten metal supplies metal between two moving casting surfaces.

5. The method of claim 1 wherein transporting the separated strip transports the strip horizontally.

6. The method of claim 1 wherein transporting the separated strip transports the strip vertically.

7. The method of claim 1 further including the roll motor speed as a master.

8. An apparatus for directly casting molten metal into continuous metal strip, the apparatus comprising:

movable casting surface, means for supplying molten metal to the casting surface, first drive means for driving the casting surface, means for separating the strip from the casting surface, at least one pair of driven rolls, second drive means for driving the rolls, means for transporting the separated strip continuously through the roll bite of the rolls, and means for synchronously controlling the angular position and speed of the driven roll means and casting surface using a master-slave relationship, the driven roll means being master and the casting surface speed being slave.

* * * * *